US008342722B1

(12) United States Patent
Opdahl

(10) Patent No.: US 8,342,722 B1
(45) Date of Patent: Jan. 1, 2013

(54) LIGHT SYSTEM

(76) Inventor: Nicholas C. Opdahl, Madison, SD (US)

( * ) Notice: Subject to any disclaimer, the term of this patent is extended or adjusted under 35 U.S.C. 154(b) by 185 days.

(21) Appl. No.: 12/704,682

(22) Filed: Feb. 12, 2010

(51) Int. Cl.
*F21S 8/00* (2006.01)

(52) U.S. Cl. ..... 362/432; 362/145; 362/147

(58) Field of Classification Search ..... 362/432, 362/145, 147
See application file for complete search history.

(56) References Cited

U.S. PATENT DOCUMENTS

| | | | | |
|---|---|---|---|---|
| 3,150,883 | A | 9/1964 | Franck et al. | |
| 6,042,246 | A * | 3/2000 | Waldmann | 362/223 |
| 6,371,632 | B1 * | 4/2002 | Lavy | 362/406 |
| 6,530,681 | B2 | 3/2003 | Sieczkowski | |
| 6,595,664 | B2 | 7/2003 | Bucher et al. | |
| 6,834,467 | B2 | 12/2004 | Gulbrandsen et al. | |
| 7,806,570 | B2 * | 10/2010 | Lanczy | 362/404 |
| 2002/0118545 | A1 * | 8/2002 | Bucher et al. | 362/404 |
| 2006/0012980 | A1 * | 1/2006 | Mize | 362/198 |
| 2006/0209527 | A1 * | 9/2006 | Shin | 362/29 |
| 2006/0274522 | A1 | 12/2006 | Williams et al. | |

OTHER PUBLICATIONS

CSN Lighting, Ixion Square Ceiling, website: http://www.csnlighting.com/Zaneem-Lighting-D9-2008-ZN1423.html.
CSN Lighting, Tecla, website: http://www.csnlighting.com/Zaneen-Lighting-D8-2030-D8-2031-ZN1246.html.
CSN Lighting, Semi Flush, website: http://www.csnlighting.com/George-Kovacs-by-Minka-P389-084-gkv1194.html.
CSN Lighting, Veneto Venti: http://www.csnlighting.com/LBL-Lighting-XX-400-LBL6228.html.
Lighting by Gregory, website: http://lightingbygregory.com/lighting/product/zn-d9-2068.html.

* cited by examiner

*Primary Examiner* — Evan Dzierzynski

(57) ABSTRACT

A light system for mounting adjacent to a wall is provided which includes an opaque panel disposed adjacent to and offset from the wall. The panel has a wall side and a lower side (facing the room in which the light system is mounted). The panel has a perimeter edge. Lights are mounted within the perimeter edge on the wall side of the panel, between the wall and the panel, such that the lights are generally not visible, but light emanating from the lights is visible to form a halo on the wall around the panel, generally conforming to the perimeter edge of the panel. An upper releasable mounting bracket and a lower releasable mounting bracket are provided where the upper releasable mounting bracket is disposed on the wall and the lower releasable mounting bracket disposed on the wall side of the panel.

7 Claims, 5 Drawing Sheets

LIGHT SYSTEM

BACKGROUND OF THE INVENTION

The present invention is directed to a light system for home or business. More particularly, the present invention is directed to a decorative light system that provides indirect lighting.

Light fixtures and, more particularly, light fixtures providing either direct lighting or indirect lighting where light is directed towards a ceiling or wall such that the light reflected off the ceiling or wall provides light to the room) are well known.

For purposes of the present invention, the term "wall" is considered to encompass walls ceilings, beams and/or other planar surfaces of houses, buildings or similar structures.

It is highly beneficial for lighting fixtures for use in homes and businesses to have an aesthetically pleasing ornamental design. Therefore, designs that provide for an unlimited number of different overall shapes would be of great desirability.

Numerous light fixtures are known in the prior art. For example, U.S. Pat. No. 3,150,833 (Franck et al.) is directed to a ceiling mounted light refractor. This invention is directed to a rectangular system for fluorescent bulbs that directs light from the bulbs in a specified manner.

U.S. Pat. No. 6,530,681 (Sieczkowski) is directed to a surface mounted ceiling lighting fixture capable of supporting decorative trim of different shapes and sizes which is capable of surface mounting to a ceiling. The fixture housing has a central aperture mounted by conventional fasteners over a junction box. Hanger bars mounted to the fixture housing receive hook-like mounting brackets which have been mounted to frame portions of decorative trim and locations which permit easy engagement of the mounting brackets with the hanger bars.

U.S. Pat. No. 6,595,664 (Bucher et al.) is directed to a quick-install, flush mount bracket for light and other fixtures which includes a bracket assembly for connecting a fixture to a support, the bracket assembly comprising a male sub-bracket for connection to one of the fixture or support, a female sub-bracket for connection to the other one of the fixture or support, the sub-brackets being complimentarily configured for coupling to one another.

U.S. Pat. No. 6,834,467 (Gulbrandsen et al.) is directed to a free form ceiling panel for suspending ceiling systems. The free form ceiling system is a grid system made up of curving members and panels.

U.S. Patent Publication No. 2006/0274522 (Williams et al.) is directed to a light fixture mounting bracket for mounting a light fixture which includes a first bracket with a first stem and a first longitudinal section which extends approximately orthogonally from the first stem, and a second bracket connected to the first bracket and with a second stem and a second longitudinal section which extends approximately orthogonally from the second stem.

All references cited herein are incorporated herein by reference in their entireties.

BRIEF SUMMARY OF THE INVENTION

A light system for mounting adjacent to a wall is provided which includes an opaque panel disposed adjacent to and offset from the wall. The panel has a wall side and a lower side (facing the room in which the light system is mounted). The panel has a perimeter edge. Lights are mounted within the perimeter edge on the wall side of the panel, between the wall and the panel, such that the lights are generally not visible, but light emanating from the lights is visible to form a halo on the wall around the panel, generally conforming to the perimeter edge of the panel. An upper releasable mounting bracket and a lower releasable mounting bracket are provided where the upper releasable mounting bracket is disposed on the wall and the lower releasable mounting bracket disposed on the wall side of the panel.

The perimeter edge of the panel may have a free-form shape. A swivel device between the lower releaseable mounting bracket and the panel may be provided to allow for rotation of the panel with respect to the wall. The panel may be generally planar. At least one lower light may be disposed on the lower side of the panel for direct lighting of a location adjacent to the lower side of the panel. The at least one lower light may be a pendant light extending from the lower side of the panel.

The upper releasable mounting bracket and the lower releasable mounting bracket may be fabricated from bent sheet metal wherein one of the mounting brackets has a planar top and two side walls extending down from the top, wherein the two side walls each have a tabs extending away from the side walls towards the top, and wherein the other of the mounting brackets has a planar bottom and two side walls extending up from the bottom, wherein the two side walls each have tabs extending away from the side walls towards the bottom. Here, each of the tabs on the one mounting bracket mate with a corresponding tab on the other of the mounting brackets. The tabs on the one of the mounting brackets may have a pair of secondary tabs disposed adjacent thereto to lock the one mounting bracket from movement parallel to the other of the mounting brackets unless combined with at least some perpendicular movement.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figures 1, 2:
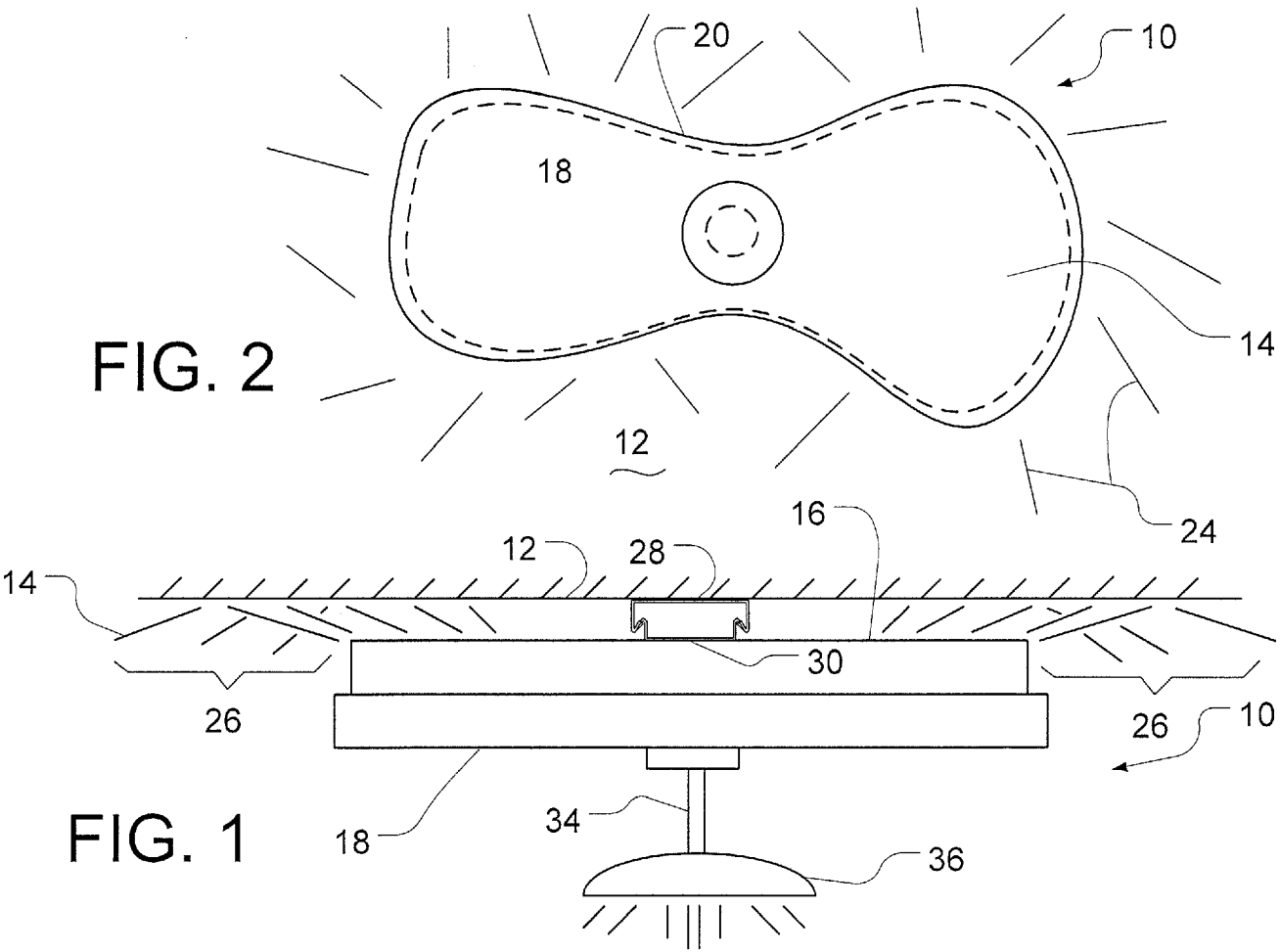
FIG. 1 is a side, elevation view of the light system in accordance with a preferred embodiment of the present invention.
FIG. 2 is bottom plan view of light system of FIG. 1.
Figure 3:
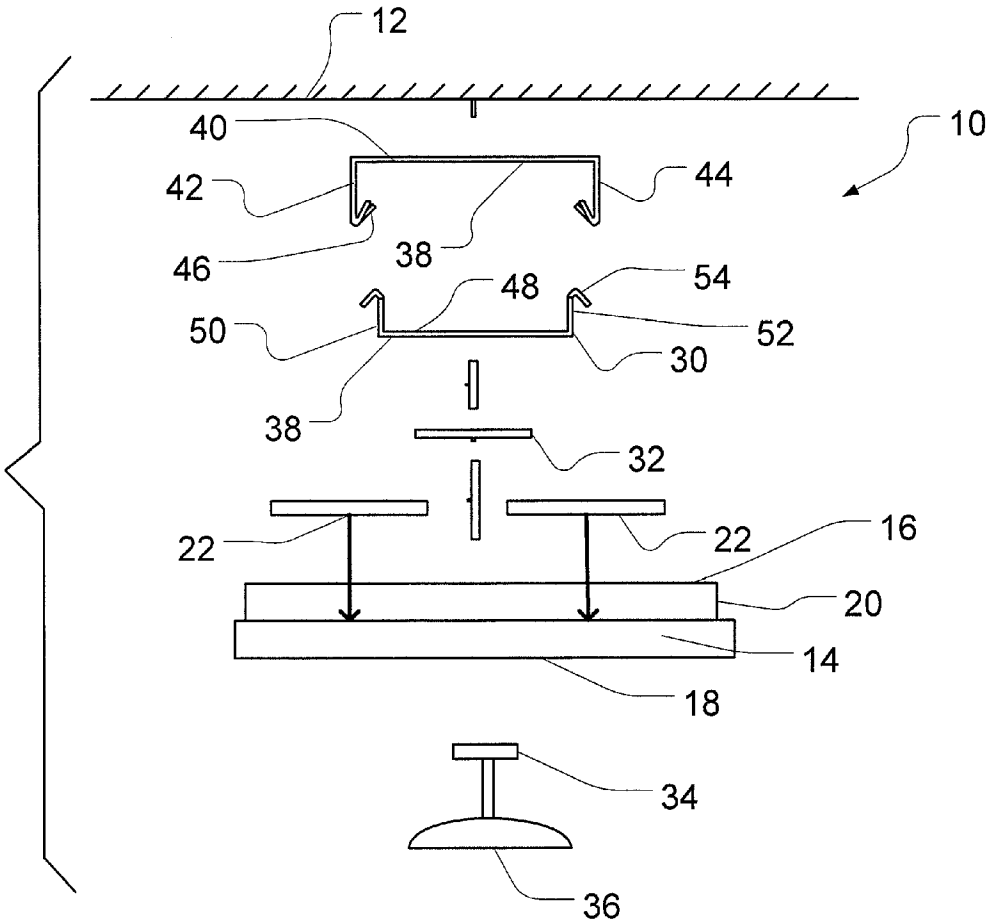
FIG. 3 is exploded, side, elevation view of the light system of FIG. 1.

Referring now to the drawings wherein like part numbers refer to like elements throughout the several views, there is shown in FIGS. 1-3 a light system 10 in accordance with a preferred embodiment of the present invention. The light system 10 is for mounting to a wall 12, ceiling, beam or the like. For purposes of the present invention, the term "wall" is intended to encompass all of these surfaces.

The light system 10 includes an opaque panel 14 disposed adjacent to and offset from the wall 12. The panel 14 has a wall side 16 and a lower side 18 and a perimeter edge 20. The perimeter edge form substantially any shape, such as the free-form shape shown in FIG. 2. For example, the perimeter edge 20 may also form a round, square, rectangular, polygonal, etc. shape.

As best seen in FIG. 3, lights 22 for indirect lighting of the wall 12, such as one or more rope lights as are well known, are mounted within the perimeter edge 20 on the wall side 16 of the panel 14, between the wall 12 and the panel 14 such that the lights 22 themselves are generally not visible, but light emanating 24 from the lights 22 is visible on the wall 12 to form a halo 26 around the panel 14, generally conforming to the perimeter edge 20 of the panel 14. See FIG. 1.

An upper releasable mounting bracket 28 and a lower releasable mounting bracket 30 are provided to mount the panel 14 to the wall 12. The upper releasable mounting bracket 30 is disposed on the wall 12 and the lower releasable mounting bracket 30 is disposed on the wall side 16 of the panel 14.

Optionally, a swivel device 32 may be provided between the lower releaseable mounting 30 bracket and the wall side 16 of the panel 14 to provide for rotation of the panel 14 with respect to the wall 12 for optimal placement on the wall 12. In the preferred embodiment of the light system 10 shown, the panel 14 is generally planar. However, the panel 14 need not necessarily be planar. For example, the panel 14 may have an undulating configuration, domed configuration, or substantially any other configuration so long as a proper halo 26 is formed on the wall 12 adjacent to the perimeter edge 20 of the panel 14.

As can be seen in FIGS. 1 and 3, one or more lower lights 34 may be disposed on the lower side 18 of the panel 14 for, for example, direct lighting of an object adjacent to the lower side of the panel. These lower lights 34 may be, for example, pendant lights 36 extending from the lower side 18 of the panel 14.

As can be seen in FIGS. 3 and 4-10, the upper releasable mounting bracket 28 and the lower releasable mounting bracket 30 are preferably fabricated from bent sheet metal 38. However, a molded plastic material or other suitable material may be used. The upper releasable mounting bracket 28 has a planar top 40 and two side walls 42, 44 extending down from the top 40. The two side walls 42, 44 each have a plurality of tabs 46 extending away from the side walls 42, 44 towards the top 40. The lower releasable mounting bracket 30 has a planar bottom 48 and two side walls 50, 52 extending up from the bottom 48. The two side walls 50, 52 each have a plurality of tabs 54 extending away from the side walls 50, 52 towards the bottom 48.

Figure 4:
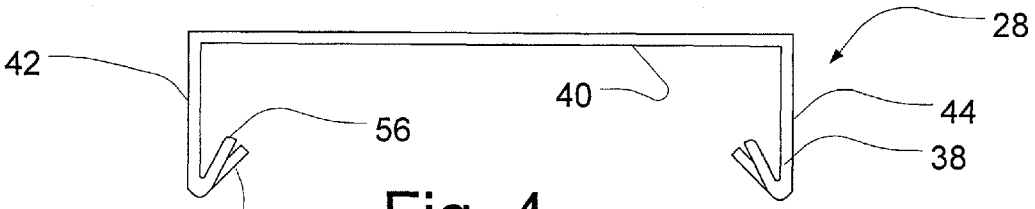
FIG. 4 is a side elevation view of an upper releasable mounting bracket of the light system of FIG. 1.
Figure 5:
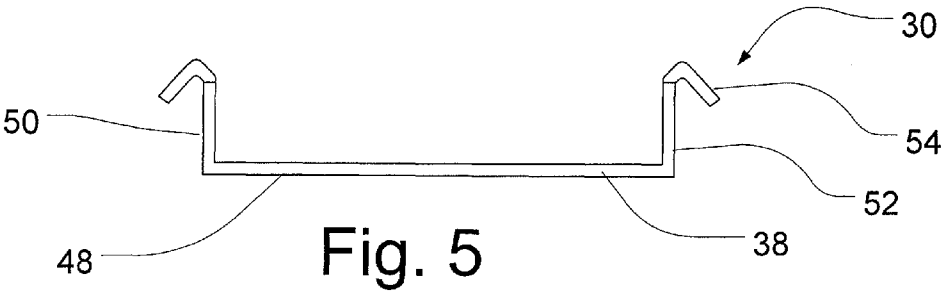
FIG. 5 is side elevation view of a lower releasable mounting bracket of the light system of FIG. 1.
Figure 6:
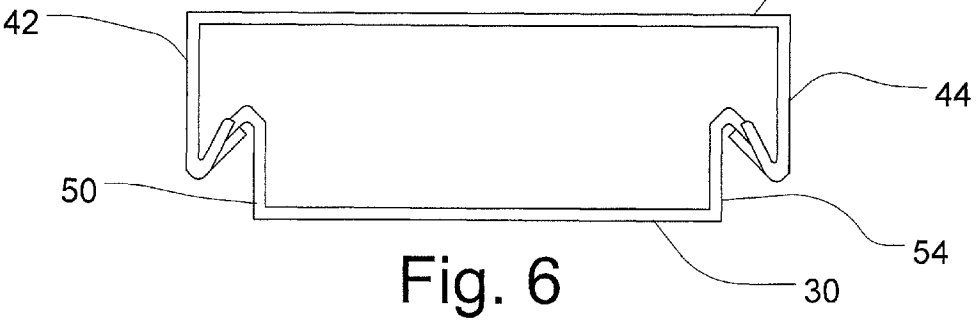
FIG. 6 is side elevation view of the upper and lower releasable mounting brackets of the light system of FIG. 1 showing the upper and lower releasable mounting brackets in a secured configuration
Figure 8:
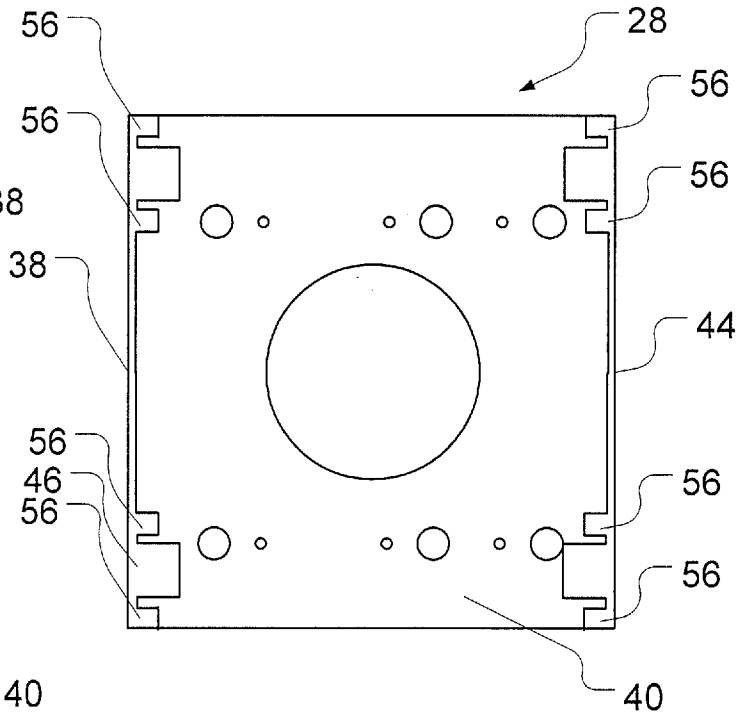
FIG. 8 is bottom, plan view of the upper releaseable mounting bracket of FIG. 4.
Figure 7:
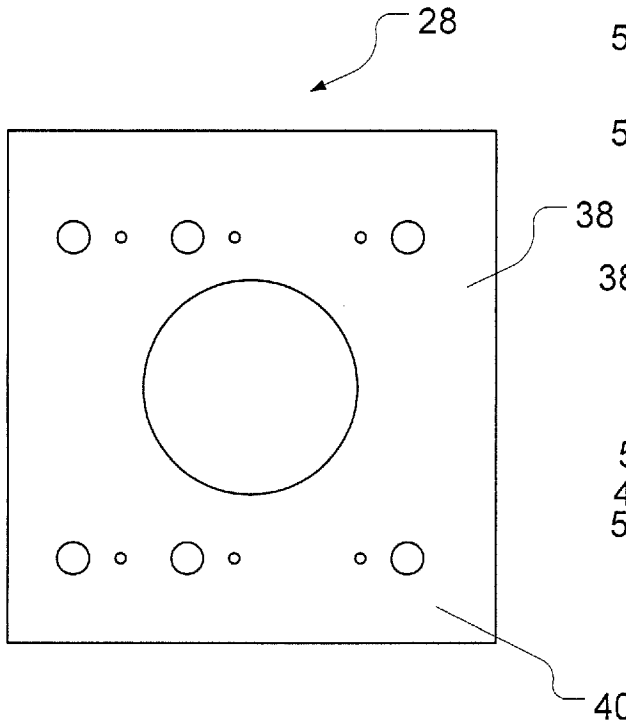
FIG. 7 is a top, plan view of the upper releasable mounting bracket of FIG. 4.
Figure 10:
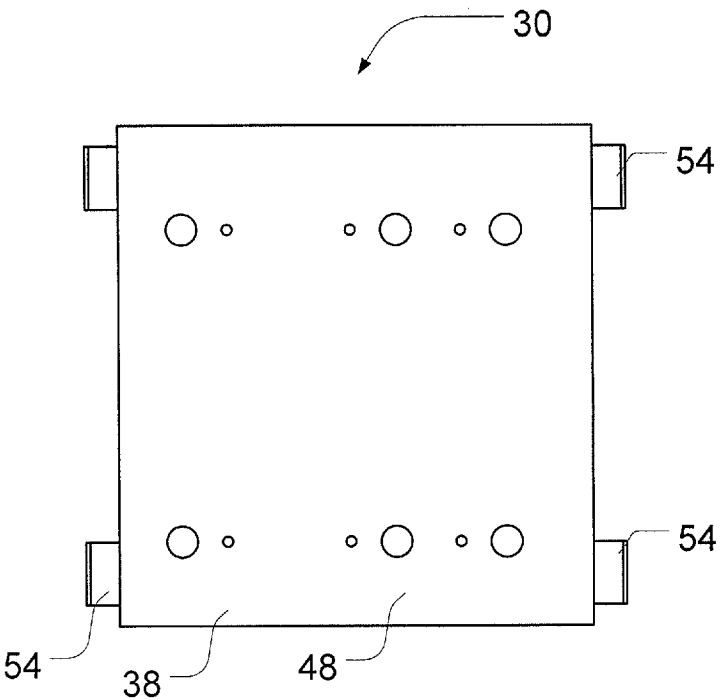
FIG. 10 is a bottom, plan view of the lower releaseable mounting bracket of FIG. 5.
Figure 9:
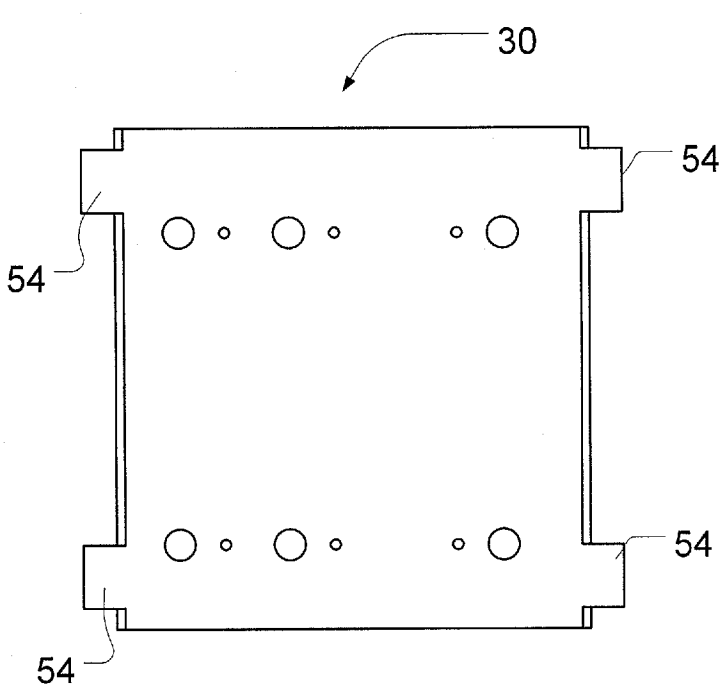
FIG. 9 is top, plan view of the lower releasable mounting bracket of FIG. 5.

As is best seen in comparing FIGS. 4 and 5 to FIG. 6 and in comparing FIG. 8 to FIG. 10, each of the tabs 46 on the upper releasable mounting bracket 28 mates with a corresponding tab 54 on the lower releasable mounting brackets 30. Specifically, as seen in FIG. 6, the side walls 42, 44 extending down from the planar top 40 of the upper releasable mounting bracket 28 slidably engage the side walls 50, 52 of the lower releasable mounting bracket and the tabs of the upper releasable mounting bracket 46 align with the tabs 54 of the lower releasable mounting bracket 30 such that, once properly mounted, the panel 14 is secured to the wall 12 from movement in a direction parallel to the wall 12. However if the panel 14 is moved inward toward the wall 12, the tabs 46, 54 no longer are in alignment such that the panel upper releasable mounting bracket 28 may be disengaged and moved away from the lower releasable mounting bracket 30.

The plurality of tabs on the upper releasable mounting bracket 28 may each have a pair of secondary tabs 56 disposed adjacent thereto to further lock the upper releasable mounting bracket 28 from movement parallel to the lower releasable mounting bracket 30 unless combined with at least some perpendicular movement. See FIG. 8

While the invention has been described in detail and with reference to specific embodiments thereof, it will be apparent to one skilled in the art that various changes and modifications can be made therein without departing from the spirit and scope thereof.

What is claimed is:

1. A light system comprising for mounting adjacent to a wall, the light system comprising:

(a) an opaque panel disposed adjacent to and offset from the wall, the panel having a wall side and a lower side, said panel having a perimeter edge and lights mounted within the perimeter edge on the wall side of the panel, between the wall and the panel such that the lights are generally not visible, but light emanating from the lights is visible on the wall to form a halo around the panel, generally conforming to the perimeter edge of the panel; and (b) an upper releasable mounting bracket and a lower releasable mounting bracket, the upper releasable mounting bracket disposed on the wall and the lower releasable mounting bracket disposed on the wall side of the panel;

(c) wherein the upper releasable mounting bracket and the lower releasable mounting bracket are fabricated from bent sheet metal wherein the upper releasable mounting bracket has a planar top and two side walls extending down from the top, wherein the two side walls of the upper mounting bracket each have a plurality of tabs extending away from the side walls towards the top, and wherein the lower releasable mounting brackets has a planar bottom and two side walls extending up from the bottom, wherein the two side walls of the lower mounting bracket each have a plurality of tabs extending away from the side walls towards the bottom, wherein the side walls of the each of the upper releasable mounting bracket and the lower releasable mounting bracket slidably engage one another and the plurality of tabs on the upper releaseable mounting bracket mate with corresponding tabs on the lower releasable mounting bracket.

2. The light system of claim 1, wherein the perimeter edge of the panel has a free-form shape.

3. The light system of claim 1, including a swivel device between the lower releaseable mounting bracket and the panel to provide for rotation of the panel with respect to the wall.

4. The light system of claim 1, wherein the panel is generally planar.

5. The light system of claim 1, including at least one lower light disposed on the lower side of the panel for direct lighting adjacent to the lower side of the panel.

6. The light system of claim 1, wherein the at least one lower light is a pendant light extending from the lower side of the panel.

7. The light system of claim 1, wherein the plurality of tabs on the upper releasable mounting bracket each has a pair of secondary tabs disposed adjacent thereto to lock the upper releasable mounting bracket from movement parallel to the lower releasable mounting bracket unless combined with at least some perpendicular movement.

* * * * *